US008813707B2

(12) United States Patent
Schmidt

(10) Patent No.: US 8,813,707 B2
(45) Date of Patent: Aug. 26, 2014

(54) METHOD FOR MESHING A STARTING PINION OF A STARTER DEVICE WITH A TOOTHED RING OF AN INTERNAL COMBUSTION ENGINE

(75) Inventor: Karl-Otto Schmidt, Keltern (DE)

(73) Assignee: Robert Bosch GmbH, Stuttgart (DE)

( * ) Notice: Subject to any disclaimer, the term of this patent is extended or adjusted under 35 U.S.C. 154(b) by 304 days.

(21) Appl. No.: 13/392,324

(22) PCT Filed: Aug. 18, 2010

(86) PCT No.: PCT/EP2010/062044

§ 371 (c)(1),
(2), (4) Date: Apr. 30, 2012

(87) PCT Pub. No.: WO2011/023613

PCT Pub. Date: Mar. 3, 2011

(65) Prior Publication Data

US 2012/0204826 A1 Aug. 16, 2012

(30) Foreign Application Priority Data

Aug. 26, 2009 (DE) ..... 10 2009 028 870

(51) Int. Cl.
*F02N 11/08* (2006.01)
*F02N 11/00* (2006.01)

(52) U.S. Cl.
USPC ..... 123/179.3; 701/111

(58) Field of Classification Search
USPC ..... 123/179.1, 179.3, 179.25; 701/111, 701/113; 290/38 R, 38 C, 48; 74/7 A, 7 C
See application file for complete search history.

(56) References Cited

U.S. PATENT DOCUMENTS

| | | | | |
|---|---|---|---|---|
| 6,901,328 | B2 | 5/2005 | Damson et al. | |
| 8,610,296 | B2 * | 12/2013 | Usami et al. | 290/38 R |
| 2001/0047785 | A1 * | 12/2001 | Osada et al. | 123/179.3 |
| 2010/0282199 | A1 | 11/2010 | Heyers et al. | |

FOREIGN PATENT DOCUMENTS

| | | |
|---|---|---|
| EP | 0727577 | 8/1996 |
| JP | 2005098245 | 4/2005 |
| WO | 2009083370 | 7/2009 |

OTHER PUBLICATIONS

PCT/EP2010/062044 International Search Report dated Nov. 26, 2010 (Translation and Original, 4 pages).

* cited by examiner

*Primary Examiner* — Mahmoud Gimie
(74) *Attorney, Agent, or Firm* — Michael Best & Friedrich LLP

(57) ABSTRACT

A method for meshing a starting pinion of a starter device with a toothed ring of an internal combustion engine includes aligning rotational speed of the starting pinion with the rotational speed of the toothed ring before meshing takes place. As meshing occurs, a vibration characteristic is measured. If a vibration characteristic variable is not within an admissible value range, activation of the starting pinion is varied during a subsequent meshing process.

14 Claims, 3 Drawing Sheets

METHOD FOR MESHING A STARTING PINION OF A STARTER DEVICE WITH A TOOTHED RING OF AN INTERNAL COMBUSTION ENGINE

BACKGROUND OF THE INVENTION

The invention relates to a method for meshing a starting pinion of a starter device with a toothed ring of an internal combustion engine.

DE 10 2006 011 644 A1 discloses a method for placing a pinion of a starter device in engagement with a toothed ring of an internal combustion engine. The engagement or meshing process may also be carried out in dynamic operating states in which the toothed ring, which is connected in terms of rotation to the crankshaft of the internal combustion engine, is moving at a rotational speed of greater than zero. In this way, faster or earlier meshing of the starting pinion with the toothed ring can take place, such that a restart of the internal combustion engine can be carried out more quickly. There are also resulting noise advantages. Said system is suitable in particular for use in a start-stop operating mode of an internal combustion engine with repeated engine shutdown and restart processes.

In DE 2006 011 644 A1, it is provided that, before the meshing of the starting pinion with the toothed ring of the internal combustion engine, the rotational speed of the starting pinion is aligned with the rotational speed of the toothed ring. Here, the difference between the rotational speeds of the starting pinion and toothed ring must not exceed a defined value.

In starter devices of said type, the problem may basically arise that, during the engagement, one or more teeth of the starting pinion do not engage into gaps between adjacent teeth of the toothed ring but rather impact directly against the teeth. The consequences are firstly a delayed engagement process and secondly increased loading of the starting pinion and of the toothed ring, which as a result are subject to increased mechanical wear. Furthermore, this process is associated with undesired noise generation.

SUMMARY OF THE INVENTION

The invention is based on the object of being able to carry out the engagement process in a starter device of an internal combustion engine quickly, with little noise and with reduced mechanical loading.

The method according to the invention relates to the meshing or engagement of a starting pinion of a starter device into a toothed ring of an internal combustion engine, wherein, before the meshing takes place, the rotational speed of the starting pinion is aligned with the rotational speed of the toothed ring. The method is carried out in particular in situations in which the toothed ring of the internal combustion engine is rotating at a rotational speed of greater than zero. In these situations, the starting pinion is preferably also accelerated to a minimum rotational speed, which is not necessarily identical to the rotational speed of the toothed ring; deviations between the rotational speeds of the starting pinion and toothed ring within an admissible defined range are basically possible. The method according to the invention thus relates, in a preferred application, to a dynamic meshing process, and is suitable in particular for so-called start-stop systems of internal combustion engines which are characterized by repeated shutdown and starting processes. For example, the internal combustion engine may be shut down when or shortly before the vehicle comes to a standstill, for example when a limit speed is undershot, wherein after the shutdown of the internal combustion engine, the starter device is immediately engaged in order to permit as fast as possible a restart of the internal combustion engine. For this purpose, the starting pinion of the starter device is adjustable between a disengaged state outside the toothed ring and an engaged state in which it meshes with the toothed ring, wherein the rotational speed of the starting pinion is aligned with the rotational speed of the toothed ring of the internal combustion engine already before the engagement or meshing takes place.

It is however also possible for the method to be used in operating states in which the internal combustion engine is at a standstill.

To reduce high mechanical loads arising as a result of impacting of the teeth of the starting pinion against the teeth of the toothed ring of the internal combustion engine at the moment of engagement, it is provided in the method according to the invention that a vibration which characterizes the engagement or meshing process is measured on the internal combustion engine and that, in the event that a vibration characteristic variable lies outside an admissible value range, the activation of the starting pinion is varied during a subsequent engagement process. If the vibration characteristic variable lies outside the admissible value range, this indicates impacting of the teeth of the starting pinion and toothed ring against one another during the meshing process. As a result of the change of a characteristic variable which characterizes the meshing process, the probability of the teeth of the starting pinion successfully passing into the gaps between the teeth of the toothed ring of the internal combustion engine is increased during the next meshing process, as a result of which the high mechanical loading arising in the event of direct tooth-on-tooth impacting is eliminated. Furthermore, noise generation is reduced, and the meshing process can be carried out in a shorter amount of time.

It is basically possible for different parameters or characteristic variables which determine the activation of the starting pinion to be varied. Consideration is given to the pinion rotational speed or the meshing time at which the pinion rotational speed is accelerated. Furthermore, the actuating movement of the starting pinion between the disengaged and engaged state, for example the advancing speed or the starting time at which the axial advancing of the starting pinion begins, may also be varied. It is basically possible for only one of said parameters or characteristic variables to be varied or for a plurality of parameters to be varied. In the case of a change in the pinion rotational speed, consideration is given to both an increase and also a reduction of the rotational speed.

The variation in the activation of the starting pinion is expediently carried out in the meshing process directly following a meshing process in which teeth abut against one another. If, in said subsequent meshing process, the change proves to be expedient in that the teeth of the starting pinion and toothed ring engage into one another in a positively locking manner, the parameters of the activation process are stored and also maintained for the further meshing processes. If it is detected that, despite changed parameters, the teeth of the starting pinion are still impacting against the teeth of the toothed ring during the meshing process, the activation process is again varied, wherein consideration is given to both a change of the same characteristic variable and also a change in a different characteristic variable or a change in a plurality of characteristic variables.

It is possible for different vibration characteristic variables to be taken into consideration in the decision as to whether tooth-on-tooth impacting is taking place during the meshing process, provided that the vibration characteristic variable in question is suitable for inferring this. The vibration characteristic variable in question is the amplitude, the frequency, the number of vibrations and the vibration mean value, wherein consideration may be given either to one of said characteristic variables or to a plurality of vibration characteristic variables combined with one another. During the check as to whether the teeth are impacting against one another during the meshing process, it is queried whether one or more of the vibration characteristic variables lies inside or outside an admissible range. If the vibration characteristic variable or vibration characteristic variables lies outside the admissible range, it must be assumed that the teeth are impacting against one another, whereupon the activation of the meshing process is varied as described above.

The invention may be used in internal combustion engines having a starter device and a regulating or control unit in which the method is carried out. To measure the vibrations which characterize the engagement process, use is expediently made of a knock sensor which is arranged on the crankcase or on the cylinder head of the internal combustion engine and by means of which the vibrations originating from the internal combustion engine can be measured. As a knock sensor, use is made of a piezo sensor, for example. On the basis of a characteristic measurement signal profile, it can be established whether the measured vibrations are actually originating from impacting of the teeth of the starting pinion and toothed ring against one another during the meshing process.

DETAILED DESCRIPTION

Figure 1:
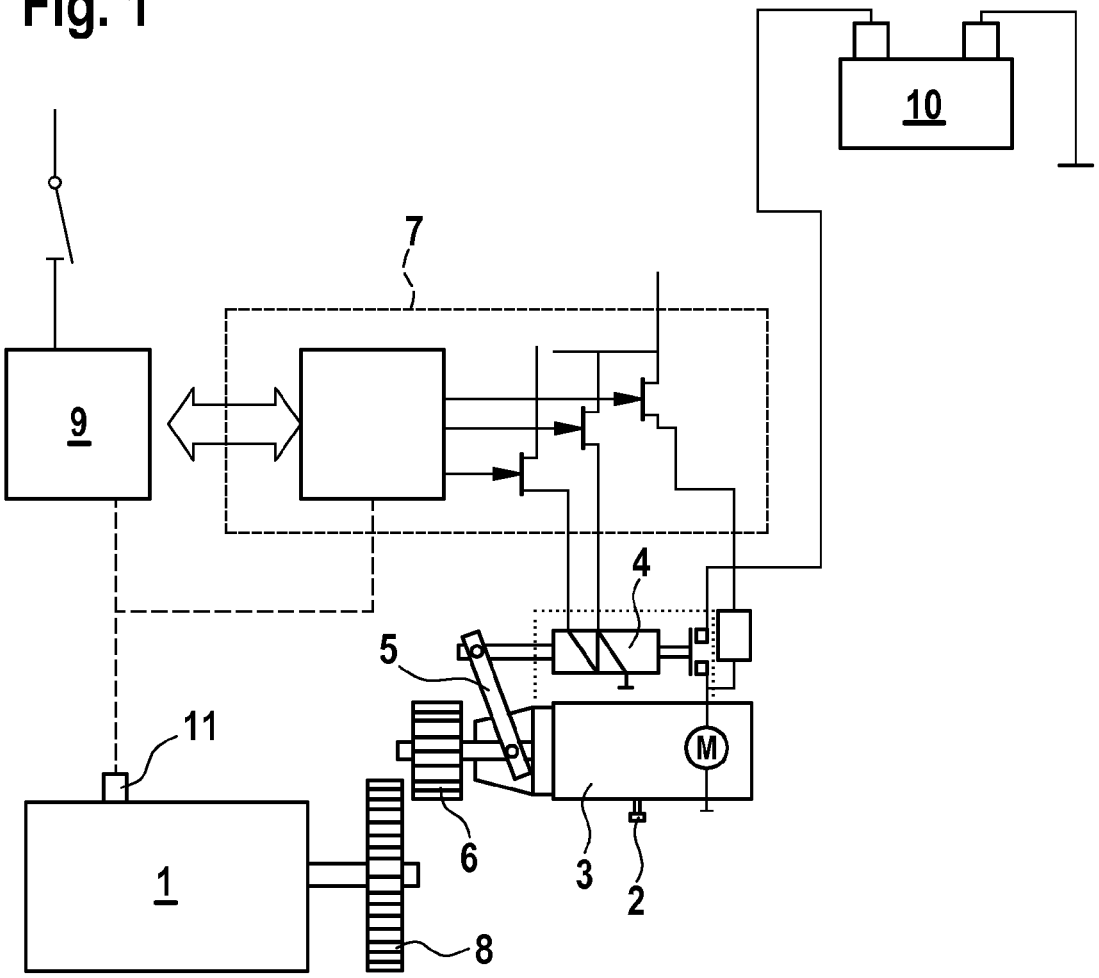
FIG. 1 shows a block circuit diagram of an internal combustion engine with a starter device.

As illustrated in FIG. 1, the internal combustion engine 1 is started by means of a starter device 2 which comprises an electric starter motor 3, a control element 4 with an engagement lever 5 for axially adjusting a starting pinion 6, and a regulating and control unit 7. The engagement or meshing process is carried out by means of the operation of the control element 4, whereupon the engagement lever 5 adjusts the starting pinion 6, which is situated in the disengaged position in which it is not in engagement with the toothed ring 8 on the internal combustion engine 1, axially forward into the engaged or meshed state in which the teeth of the starting pinion 6 mesh with the teeth of the toothed ring 8 which is connected to the crankshaft of the internal combustion engine. The rotational speed of the starting pinion 6 can be increased by means of the electric starter motor 3 already before the engagement takes place. Here, the rotational speed of the starting pinion 6 is in particular dimensioned in accordance with the rotational speed of the toothed ring 8, wherein deviations between the rotational speeds of the starting pinion 6 and of the toothed ring 8 up to a predefined value are admissible. The electrical energy supply to the starter device 2 is provided by means of a battery 10.

The operation of the electric starter motor 3 and of the control element for the engagement and disengagement of the starting pinion 6 is realized by means of control signals from the regulating and control unit 7, which communicates with a further control unit 9 of the internal combustion engine. Defined for the activation of the starting pinion 6 are, in particular, the pinion rotational speed, the starting time for the rotational acceleration of the starting pinion and the end time at which the desired pinion rotational speed is reached, the starting time at the start of the axial engagement process by means of the operation of the control element 4, and the end time at which the engagement process is complete.

The internal combustion engine 1 is equipped with a knock sensor 11 which is formed preferably as a piezo sensor in which mechanical vibrations generate a voltage. The signals of the knock sensor 11 are supplied as input signals to the motor vehicle control unit 9 and/or to the regulating and control unit 7 of the starter device 2. The activation of the starter device 2, that is to say both of the electric starter motor 3 and also of the electric control element 4, takes place as a function of the measurement signals from the knock sensor 11.

Figure 2:
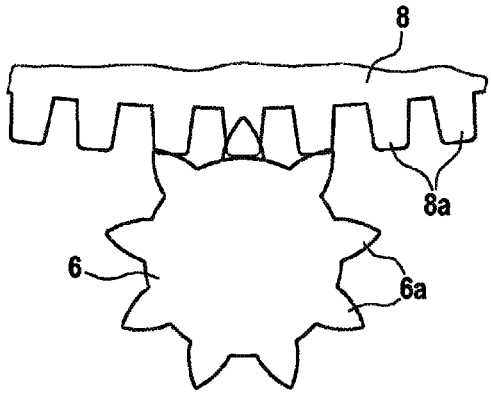
FIG. 2 shows a schematic illustration of the rows of teeth of the starting pinion on the starter device and of the toothed ring on the internal combustion engine during a meshing process, with a plurality of teeth impacting directly against one another.

FIG. 2 schematically shows impacting of the teeth 6*a* of the starting pinion 6 against the teeth 8*a* of the toothed ring 8. This state may arise during the engagement process, wherein basically either only one tooth 6*a* of the starting pinion may impact against one tooth 8*a* of the toothed ring, or a plurality of teeth 6*a* may impact against a plurality of teeth 8*a*. At the moment of impact of the teeth, high mechanical loads are generated which lead to increased wear both of the starting pinion 6 and also of the toothed ring 8 and to increased noise generation.

Figure 3:
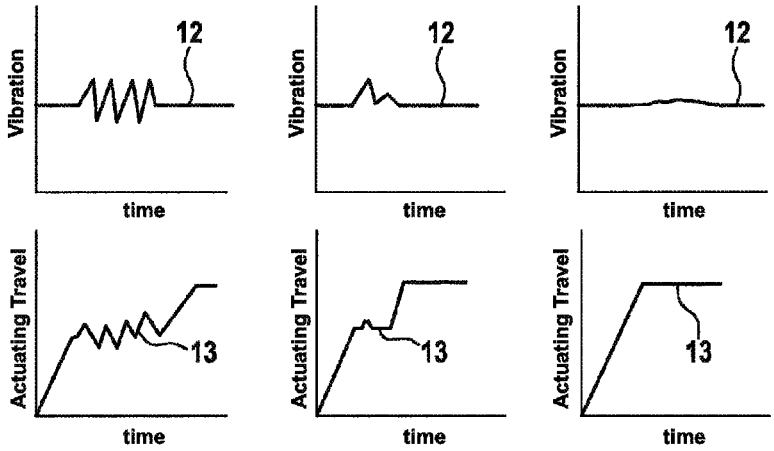
FIG. 3 shows different diagrams of profiles of the vibration signal of the internal combustion engine as recorded by a knock sensor, together with the respectively associated actuating travel of the starting pinion during the meshing process.

FIG. 3 illustrates different diagrams, wherein the upper diagrams illustrate the vibration profile measured during the engagement process by means of the knock sensor on the internal combustion engine, and the lower diagrams depict the respectively associated actuating travel of the starting pinion. The diagram at the top left represents impacting of a plurality of teeth of the starting pinion against a plurality of teeth of the toothed ring at the moment of engagement, as illustrated in FIG. 2. This process leads to multiple vibrations of relatively large amplitude. The profile of the actuating travel 13 of the starting pinion corresponds to this, wherein the profile initially pauses at a mid-level and vibrates around said mid-level until finally the teeth of the starting pinion protrude into the gaps between adjacent teeth of the toothed ring and the starting pinion has reached its final position.

The two middle diagrams illustrate the situation in which only one tooth 6*a* of the starting pinion impacts against one tooth 8*a* of the toothed ring. The vibration decays more quickly than in the case of the impacting of multiple teeth against one another, and has a smaller amplitude. The two diagrams on the right-hand side illustrate the desired engagement process in which the teeth 6*a* of the starting pinion immediately successfully pass into the gaps between teeth 8*a* of the toothed ring during the engagement process; practically no vibration is generated during said process.

Figure 4:
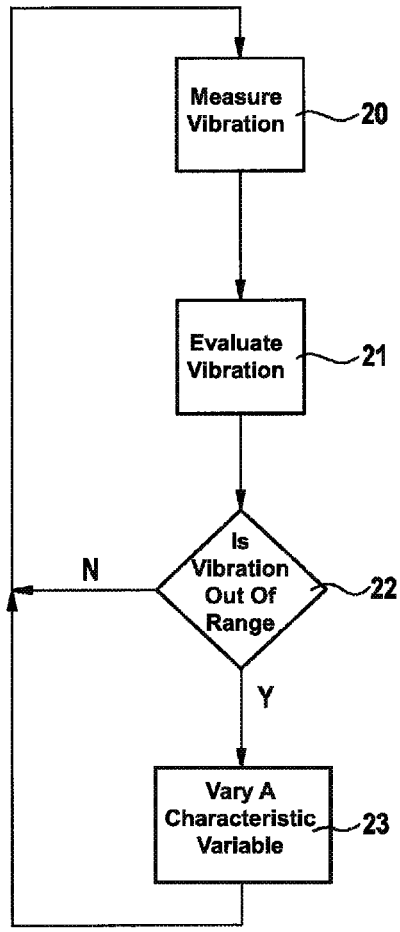
FIG. 4 shows a flow diagram with the individual method steps for carrying out the method.

The flow diagram as per FIG. 4 shows the individual method steps. Initially, in a first method step 20, the vibrations arising at the internal combustion engine are measured by means of the knock sensor. In the next method step 21, the measured vibrations are evaluated, in particular with regard to vibration characteristic variables such as amplitude, number of vibrations, frequency and vibration mean value.

In the next method step 22, at least one vibration characteristic variable is checked for exceedance of an admissible value range. If this is not the case, all the vibration characteristic variables lie in the admissible range, and the no branch ("N") is followed back to the start of the method, which is repeated cyclically at intervals. In this case, it can be assumed that a correct engagement process has taken place, during which the teeth of the starting pinion have successfully passed straight away into the gaps between teeth of the toothed ring.

However, if the one or more vibration characteristic variables taken into consideration lie outside the admissible range, the yes branch ("Y") is followed to the next method step 23, in which a characteristic variable of the activation of the starting pinion is varied. Said characteristic variable is for example the pinion rotational speed, which may be increased or decreased, the meshing time at which the electric starter motor is started and the starting pinion is accelerated to the desired rotational speed, or parameters concerning the axial advancing of the starting pinion, in particular the start and end times of the actuating process. These parameters concerning the activation of the starter device are stored and are used in a subsequent engagement process.

The invention claimed is:

1. A method for meshing a starting pinion of a starter device with a toothed ring of an internal combustion engine, the method comprising:

before meshing takes place, aligning the rotational speed of the starting pinion with a rotational speed of the toothed ring, during a meshing process, measuring vibrations which characterize the meshing process on the internal combustion engine, and if a vibration characteristic variable lies outside an admissible value range, varying an activation of the starting pinion of the starter device during a subsequent meshing process.

2. The method as claimed in claim 1, wherein during the activation of the starting pinion, the pinion rotational speed is changed.

3. The method as claimed in claim 1, wherein during the activation of the starting pinion, a meshing time is changed.

4. The method as claimed in claim 1, wherein the starting pinion can be adjusted between a disengaged state and an engaged state in which it meshes with the toothed ring, and in that, during the activation of the starting pinion, the actuating movement of the starting pinion between the disengaged and engaged states is changed.

5. The method as claimed in claim 4, wherein an advancing speed of the starting pinion is changed.

6. The method as claimed in claim 4, a starting time of the advancing of the starting pinion is changed.

7. The method as claimed in claim 1, wherein a vibration amplitude is taken into consideration as a vibration characteristic variable of the vibrations which characterize the meshing process.

8. The method as claimed in claim 1, wherein a vibration frequency is taken into consideration as a vibration characteristic variable of the vibrations which characterize the meshing process.

9. The method as claimed in claim 1, wherein a number of vibrations is taken into consideration as a vibration characteristic variable of the vibrations which characterize the meshing process.

10. The method as claimed in claim 1, wherein a vibration mean value is taken into consideration as a vibration characteristic variable of the vibrations which characterize the meshing process.

11. A regulating and control unit for carrying out the method as claimed in claim 1.

12. An internal combustion engine having a starter device and a regulating and control unit as claimed in claim 11.

13. The internal combustion engine as claimed in claim 12, wherein the internal combustion engine is equipped with a knock sensor.

14. The internal combustion engine as claimed in claim 13, wherein the knock sensor is designed as a piezo sensor.

* * * * *